US011724922B2

(12) United States Patent
Alexander

(10) Patent No.: US 11,724,922 B2
(45) Date of Patent: Aug. 15, 2023

(54) PORTABLE CRANE AND CANTILEVERED BASE SYSTEM

(71) Applicant: Ai-Structural Products, LLC, Chapel Hill, NC (US)

(72) Inventor: W. Joseph Alexander, Chapel Hill, NC (US)

(73) Assignee: Ai-Structural Products, LLC, Chapel Hill, NC (US)

( * ) Notice: Subject to any disclaimer, the term of this patent is extended or adjusted under 35 U.S.C. 154(b) by 7 days.

(21) Appl. No.: 17/481,715

(22) Filed: Sep. 22, 2021

(65) Prior Publication Data

US 2022/0089418 A1 Mar. 24, 2022

Related U.S. Application Data

(60) Provisional application No. 63/081,430, filed on Sep. 22, 2020.

(51) Int. Cl.

| | |
|---|---|
| ***B66C 23/06*** | (2006.01) |
| ***B66C 23/84*** | (2006.01) |
| ***B66C 23/82*** | (2006.01) |
| ***B66C 23/70*** | (2006.01) |

(52) U.S. Cl.

CPC ..... *B66C 23/84* (2013.01); *B66C 23/06* (2013.01); *B66C 23/701* (2013.01); *B66C 23/82* (2013.01); *B66C 2700/0371* (2013.01); *B66C 2700/0378* (2013.01)

(58) Field of Classification Search

CPC ..... B66C 23/06; B66C 23/46; B66C 23/48; B66C 23/82

See application file for complete search history.

(56) References Cited

FOREIGN PATENT DOCUMENTS

| | | | | |
|---|---|---|---|---|
| FR | 2587017 A1 * | 3/1987 | ..... | B66C 23/44 |
| GB | 2326629 A * | 12/1998 | ..... | B66C 23/06 |
| GB | 2520028 A * | 5/2015 | ..... | B66C 23/48 |

OTHER PUBLICATIONS

FR 2587017 A1 Machine Translation (Year: 1987).*

* cited by examiner

*Primary Examiner* — Michael R Mansen
*Assistant Examiner* — Juan J Campos, Jr.
(74) *Attorney, Agent, or Firm* — NK Patent Law

(57) ABSTRACT

The focus of the present disclosure is on portable cranes and cantilevered base systems. In particular, portable cranes and cantilevered base systems which are lightweight, easy-to-operate, safe, inexpensive, and have extended reaches with high-load capacities would be advantageous for a variety of applications. A cantilevered support to a pivotable arm that is provided by the present disclosure provides advantages when compared to other portable cranes, such as the ability to: 1) extend an arm and reach of a crane, 2) increase a load that can be lifted or lowered, 3) operate a portable crane and cantilevered base system freestanding without attaching a base to a floor, surface, or bed of a vehicle, and 4) augment the structural capacity of a portable crane and cantilevered base with mechanical devices to support a variety of applications.

9 Claims, 16 Drawing Sheets

PORTABLE CRANE AND CANTILEVERED BASE SYSTEM

CROSS-REFERENCE TO RELATED APPLICATIONS

This application claims priority to U.S. Provisional Patent Application No. 63/081,430 filed on Sep. 22, 2020, and entitled Portable Crane and Cantilevered Base System, the entire contents of which are incorporated by reference herein.

TECHNICAL FIELD

The present disclosure relates to cranes. More particularly, the present disclosure relates to portable cranes and cantilevered base systems.

BACKGROUND

Cranes have a long history of use to lift, lower, hold, or transport loads and have a wide variety of types, functions, and sizes. Small cranes where lift capacities are typically rated at less than a ton may be used for example in workshops, garages, on trailers, in truck beds, at farms, or inside buildings at construction sites. In contrast, a variety of large cranes are rated for substantially greater lift capacities than small cranes and are used, for example, in manufacturing, construction, ship building, and transportation.

The focus of the present disclosure is on small cranes (i.e., lift capacity typically less than a ton); that are portable (i.e., typically small and lightweight enough to be carried or moved about by one or two persons and can be positioned into a mobile or non-mobile vehicle for transport and operation at another location); with a cantilevered base system for supporting a vertically pivotal arm (i.e., at least one arm can extend beyond a wide-based frame to increase the reach of the crane or positioned at different inclinations to support a designated [i.e., rated] load without the crane tipping over); rotatable (i.e., a plurality of wheels integrated beneath a base or between two bases to enable 360 degree horizontal rotation of a wide-based frame and portable crane); freestanding (i.e., the crane can be operated without the need to attach the base to a floor, surface, or the bed of a motorized or non-motorized vehicle); and versatile (i.e., supports a variety of different mechanical operations and can accommodate a combination of one or more detachably secured counterbalance systems and/or mechanical lifting devices for supporting the load held by one or more extended arms of the crane wherein, in operation, a cantilevered base system may be augmented to support an extended reach of the crane and/or an increased load on an arm). In particular, portable cranes which are lightweight, easy-to-operate, safe, inexpensive, and have extended reaches with high-load capacities would be advantageous for a variety of applications. However, the present disclosure is not limited to small portable cranes and cantilevered base systems as moderate to large portable cranes may benefit from the features.

SUMMARY

This summary is provided to introduce in a simplified form concepts that are further described in the following detailed descriptions. This summary is not intended to identify key features or essential features of the claimed subject matter, nor is it to be construed as limiting the scope of the claimed subject matter.

In at least one embodiment, a portable crane and cantilevered base system is comprised of a wide-based frame and an interconnected horizontally rotatable base system. The long portion of an arm (which may also be referred to as a boom or beam), pivots on a wide-based frame at a pivot point (which may also be referred to as an axle or fulcrum) on a front leg of a wide-based frame where a short portion of an arm extends on a backside of the pivot point.

In one embodiment a wide-based frame may be represented by a trapezoid wherein the lower member of the frame is parallel to the upper member of the frame, and the front leg is not parallel to the back leg creating a frame that is wider at the bottom than at the top. However, other embodiments may rely on other geometric shapes (e.g., a triangle or trapezium) that can be used to achieve a wide-based frame that when positioned off-centered on the back side of rotating base system or non-rotating base provides cantilevered support to an arm that extends beyond the extent of a base in the direction of the designated load. This disclosure is therefore not limited to a specific geometric shape of a wide-based frame as long as the frame is sider at the bottom than at the top; however, a trapezoidal shape will be used for consistency in descriptions.

In another embodiment the portable crane and cantilevered base system is comprised of a wide-based frame and an interconnected rotatable base and accommodates one or more detachably secured mechanical lifting devices connected to at least one arm of the crane for increasing or decreasing the lift of an arm and structurally supporting the load held by one or more extended arms of the crane wherein, in operation, the cantilevered base system may be augmented to support an extended reach of the crane and/or an increased load on an arm.

In another embodiment, the portable crane and cantilevered base system is comprised of a wide-based frame and an interconnected rotatable base which accommodates one or more detachably secured counterbalance systems for offsetting the load held by one or more extended arms of the crane, wherein, in operation, the portable crane and cantilevered base system may be augmented to support an extended reach of an arm and/or an increased load on an arm.

In another embodiment, the portable crane and cantilevered base system is comprised of a wide-based frame and an interconnected rotatable base which accommodates a combination of one or more detachably secured counterbalance systems and mechanical lifting devices used for supporting the load held by one or more extended arms wherein, in operation, a portable crane and cantilevered base system may be augmented to support an extended reach of an arm and/or an increased load on an arm.

In another embodiment, the portable crane and cantilevered base system is comprised of a wide-based frame and an interconnected rotatable base which accommodates arms of different lengths or lateral extension of the reach of the crane by telescopic arms.

In another embodiment, the portable crane and cantilevered base system is comprised of a wide-based frame and an interconnected rotatable base which accommodates mechanical winding devices, wire rope, and associated mechanical hardware for increasing or decreasing the inclination of an arm as an arm rotates around the pivot point on one leg of a wide-based frame.

In another embodiment, the portable crane and cantilevered base system is comprised of a wide-based frame and an interconnected horizontally rotatable base which accommodates detachably secured mechanical winding devices, wire rope, and associated mechanical hardware for raising or lowering a designated load of an arm at a desired inclination set on a wide-based frame.

In another embodiment, the portable crane and cantilevered base system is comprised of a wide-based frame and an interconnected rotatable base which accommodates segments of wire rope or chain and associated mechanical hardware detachably secured to an arm and wide-based frame to hold an arm at a desired inclination and/or support an increased load on an arm (i.e., guy-wires).

In another embodiment, the portable crane and cantilevered base system is comprised of a wide-based frame and an interconnected rotatable base which accommodates free-standing operation of the crane without the need to attach a base to a floor, surface or bed of a motorized or non-motorized vehicle to support a variety of mechanical applications.

In the embodiments described above, a load (e.g., a mass or weight) may be raised or lowered by at least one arm of a portable crane and cantilevered base system by the use of wheels, pulleys, mechanical or motorized winches, wire rope, chains, and/or hoists.

The portable crane and cantilevered base system described in the present disclosure provides advantages when compared to other portable cranes disclosed in the prior art. These advantages include, but are not limited to the ability to: 1) extend an arm and therefore the reach of a crane, 2) increase the load that can be lifted or lowered by the crane's arm, 3) operate the portable crane and cantilevered base system freestanding without the need to attach a base to a floor, surface, or bed of a motorized or non-motorized vehicle, and 4) augment the structural capacity of a portable crane by the addition of mechanical devices to support a variety of applications.

BRIEF DESCRIPTION OF THE DRAWINGS

The previous summary and the following detailed descriptions are to be read in view of the drawings, which illustrate particular exemplary embodiments and features as briefly described below. The summary and detailed descriptions, however, are not limited to only those embodiments and features explicitly illustrated. The drawings and descriptions consistently refer to the front of the portable crane and cantilevered base system as the side that has the designated load whereas the wide-based frame is offset on the back side of the underlying base(s).

DETAILED DESCRIPTIONS

Figure 1:
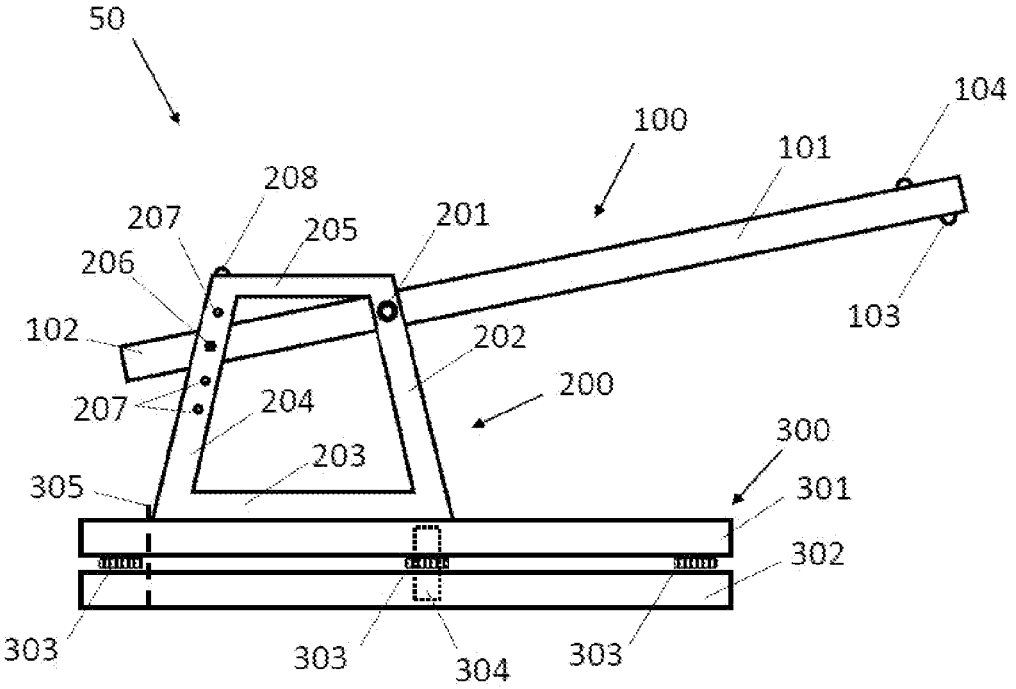
FIG. 1 is a side elevation view showing a portable crane and cantilevered base system comprised of a wide-based frame, an interconnected and horizontally rotatable base, and a vertically pivotable arm connected to the wide-based frame.

These descriptions are presented with sufficient details to provide an understanding of one or more particular embodiments of broader inventive subject matters. These descriptions expound upon and exemplify particular features of those particular embodiments without limiting the inventive subject matters to the explicitly described embodiments and features. Considerations in view of these descriptions will likely give rise to additional and similar embodiments and features without departing from the scope of the inventive subject matters. Although the term "step" may be expressly used or implied relating to features of processes or methods, no implication is made of any particular order or sequence among such expressed or implied steps unless an order or sequence is explicitly stated.

Any dimensions expressed or implied in the drawings and these descriptions are provided for exemplary purposes. Thus, not all embodiments within the scope of the drawings and these descriptions are made according to such exemplary dimensions. The drawings are not made necessarily to scale. Thus, not all embodiments within the scope of the drawings and these descriptions are made according to the apparent scale of the drawings with regard to relative dimensions in the drawings. However, for each drawing, at least one embodiment is made according to the apparent relative scale of the drawing.

The drawings and descriptions consistently refer to the front of the portable crane and cantilevered base system as the side that has the designated load whereas the wide-based frame is offset on the back side of the underlying base(s).

FIG. 1 is a side elevation view showing a portable crane and cantilevered base system (referred to interchangeably in the following descriptions as a portable crane and cantilevered base system 50, or system 50 for short) comprised of vertically pivotable arm 100, a wide-based frame 200, and an interconnected and horizontally rotatable base system 300. The long portion 101 of an arm 100 (which may also be referred to as a boom or beam), pivots on a wide-based frame 200 at a pivot point 201 (which may also be referred to as an axle or fulcrum) on the front leg 202 near the top of a wide-based frame 200 where a short portion 102 of an arm 100 extends on the backside of the pivot point 201.

In one embodiment shown in FIG. 1, a wide-based frame 200 may be represented by trapezoid wherein the lower member 203 of the frame is parallel to the upper member 205 of the frame 200, and the front leg 202 is not parallel to the back leg 204 and the wide-based frame is wider at the bottom 203 than at the top 205. However, other embodiments may rely on other geometric shapes (e.g., a triangle or trapezium) that can be used to achieve a wide-based frame 200 that when positioned on the back side of rotating base system 300 or non-rotating base provide cantilevered support to an arm 100. This disclosure is therefore not limited to a geometric shape of a wide-based frame 200; however, a trapezoidal shape will be used for consistency in the drawings and descriptions.

The back leg 204 of a wide-based frame 200 shown in FIG. 1 has holes 207 for placement of a detachably secured lockpin 206, as one example, that when engaged with the short portion of an arm 102 secures the entire arm 100 from rotation. When the lockpin 206 (which may also be referred to as a bolt or similar device) is removed from the selected hole 207 in the back leg 204 of a wide-based frame 200, an arm 100 is free to rotate up or down, and when a desired inclination of an arm is reached, the lockpin 206 is reinserted in a selected hole 207 in the back leg 204 and extended through the short portion of an arm 102 to secure the entire arm 100 from rotation. Hardware (not shown in FIG. 1) but later described in this disclosure can be used to prevent the lockpin 206 or pivot point 201 from dislocating during operation.

Hardware (e.g., loop, ring, or hook) may be engaged with the bottom of an arm 103, the top of an arm 104, or the sides of an arm (not shown) to attach guy-wires or similar support systems (not shown) to augment support of a load to system 50. Similar hardware may be engaged with the top 208 of a wide-based frame 200, or the sides and/or bottom of a wide-based frame 200 to attach guy-wires or similar support systems (not shown).

In the preferred embodiment shown in FIG. 1, one or more interconnected bases are detachably secured to a wide-based frame 200 forming a base system 300 for a portable crane and cantilevered base system. The base system 300 shown in FIG. 1 consists of an upper base 301 that extends further toward the front of system 50 than in the back to provide cantilevered support to the vertically pivotable arm 100. A lower base 302 is separated from and parallel to the upper base 301 by a plurality of wheels 303 (e.g., casters or rollers). The two bases are interconnected by a center pivot point 304 enabling 360-degree horizontal rotation of system 50. A detachably secured lockpin 305, as one example, is shown to secure the upper base 301 and lower base 302 to prevent the base system 300 from rotation during operation or transport.

Figure 2:
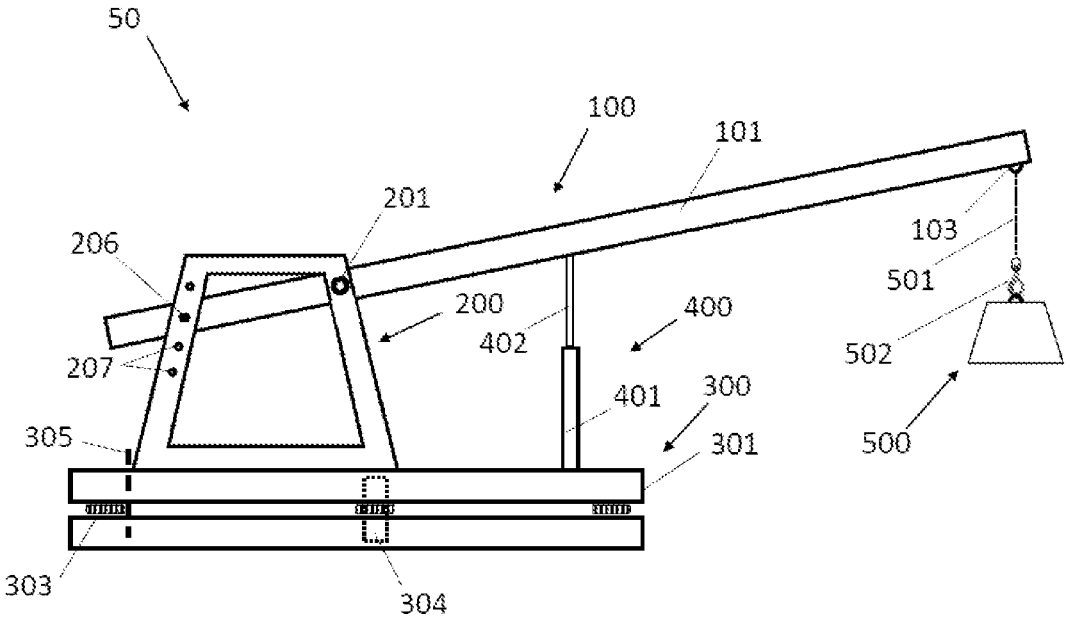
FIG. 2 is a side elevation view showing a portable crane and cantilevered base system comprised of a wide-based frame and an interconnected rotatable base where support of an extended pivotal arm and a designated load are augmented by a mechanical lifting device detachably secured to the front of a base.

FIG. 2 is a side elevation view showing a portable crane and cantilevered base system 50 comprised of a pivotal arm 100 with an extended reach (relative to FIG. 1), a wide-based frame 200 and an interconnected rotatable base system 300. A pivotal arm 100 and designated load 500 are supported by a mechanical lifting device 400 detachably secured to the front of an upper base 301 to augment support of a load 500 to a system 50. The mechanical lifting device 400 could include, for example, a jack (e.g., hydraulic, screw, or scissors) but not be limited by such devices.

In the example shown in FIG. 2 the base 401 of the mechanical lifting device 400 is wider than the top 402 which could represent, for example, a piston. In the example shown in FIG. 2, the mechanical lifting device is providing additional structural support to the extended arm 101 and reach of the crane (relative to FIG. 1), and could be used, for example to augment a system 50 to support a designated load 500 on an extended arm. In this example, the designated load 500 is supported by hardware 103 at the bottom of an arm 101, a wire rope 501 (or chain or equivalent), and a hook 502 (or equivalent). The mechanical lifting device 400 could also be used in operation to change the inclination of an arm 101, once the detachably secured lockpin 206 is removed from a hole 207 in a wide-based frame 200.

Figure 3:
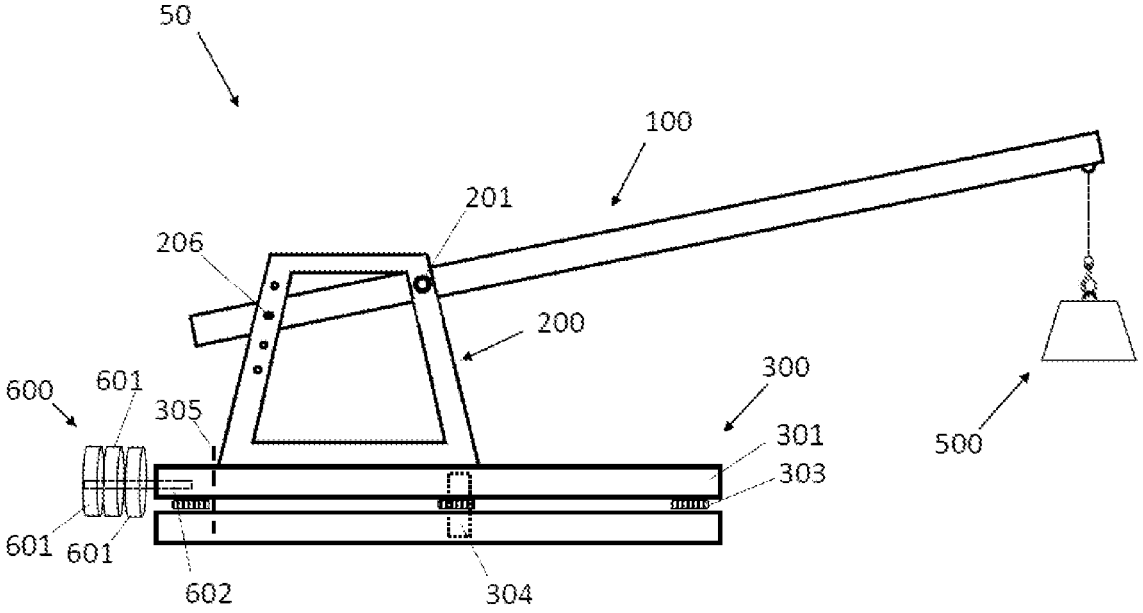
FIG. 3 is a side elevation view showing a portable crane and cantilevered base system comprised of a wide-based frame and an interconnected rotatable base where support of an extended pivotal arm and designated load are augmented by a counterbalance system detachably secured to the back of a base.

FIG. 3 is a side elevation view showing a portable crane and cantilevered base system 50 comprised of with an arm 100 with an extended reach (relative to FIG. 1), a wide-based frame 200, and an interconnected rotatable base system 300. A pivotal arm 100 and designated load 500 are supported by a counterbalance system 600 detachably secured to the back of an upper base 301 to augment support of system 50. In the example shown in FIG. 3 a rod or similar device 602 attached to an upper base 301 is used to support individual counterweights 601 detachably secured to 602. In the example shown in FIG. 3, the counterbalance system 600 could be used, for example to augment a system 50 to support a designated load 500 on an extended arm 100.

Figure 4:
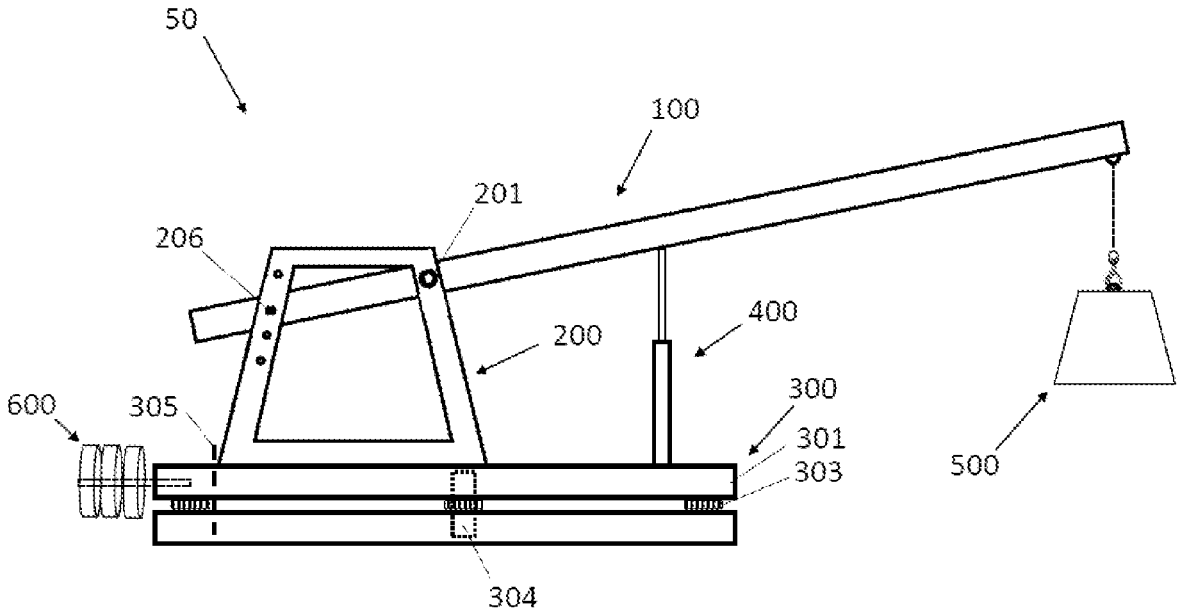
FIG. 4 is a side elevation view showing a portable crane and cantilevered base system comprised of a wide-based frame and an interconnected rotatable base where support of an extended pivotal arm and designated load are augmented by a combination of a counterbalance system on the back of a base and a mechanical lifting device on the front of a base both detachably secured to a base.

FIG. 4 is a side elevation view of a portable crane and cantilevered base system 50 comprised of a pivotal arm 100 with an extended reach (relative to FIG. 1), a wide-based frame 200, and an interconnected rotatable base system 300. A combination of a counterbalance system 600 on the back of an upper base 301 and a mechanical lifting device 400 on the front of an upper base 301, both detachably secured to a base 301, augment support of the arm 100 and designated load 500 of system 50.

Figure 5:
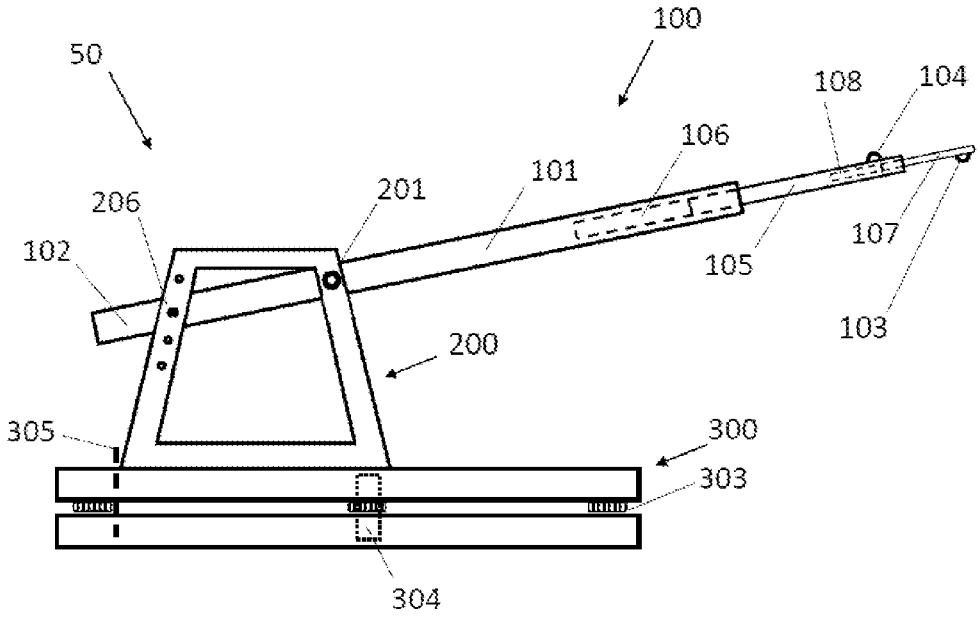
FIG. 5 is a side elevation view showing a portable crane and cantilevered base system comprised of a wide-based frame and an interconnected rotatable base where an arm is telescopically extendable.

FIG. 5 is a side elevation view of a portable crane and cantilevered base system 50 comprised of a wide-based frame 200 and an interconnected rotatable base system 300 showing telescopic arms 105 and 107. In the example shown in FIG. 5, telescopic arm 105 fits inside a cavity 106 inside a larger arm 101. Similarly, telescopic arm 107 fits inside a cavity 108 inside a larger arm 105. The physical or mechanical means of extracting or retracting an arms are not shown.

Figure 6:
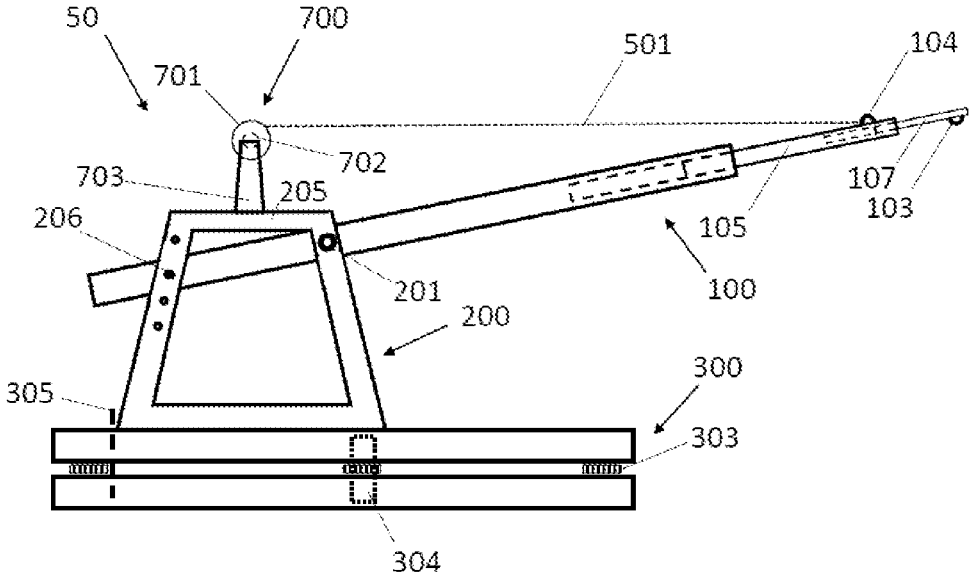
FIG. 6 is a side elevation view showing a portable crane and cantilevered base system comprised of a wide-based frame and an interconnected rotatable base where the inclination and support of a telescopic arm are augmented by a mechanical winding device.

FIG. 6 is a side elevation view showing a portable crane and cantilevered base system 50 comprised of a wide-based frame 200 and an interconnected rotatable base system 300 where the inclination and support of the telescopic arm 100 is provided by a mechanical winding device 700 (e.g., a hand-cranked or motorized winch). In this example, hardware 104 is attached to telescopic arm 105 and connected to the mechanical winding device 700 by a wire rope 501 or equivalent. The wire rope 501 is held within a reel 701 or equivalent with walls to retain wound wire rope 501, which is wound around a cylindrical core 702 of the reel on an axle or shaft (not shown). The winding device shown in FIG. 6 is attached to the upper member 205 of a wide-based frame 200 by a mount 703.

Figure 7A:
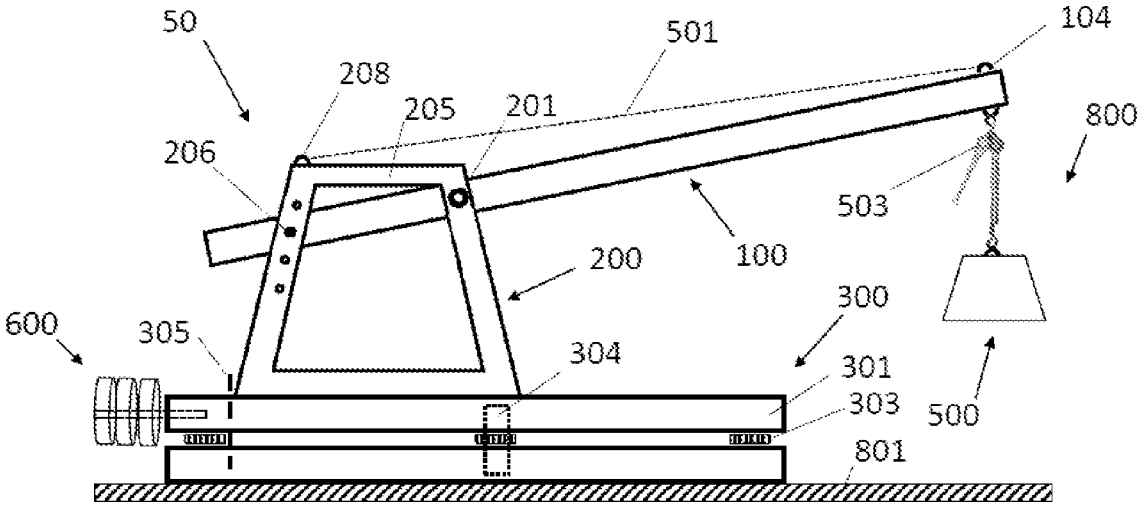
FIG. 7A is a side elevation view showing a portable crane and cantilevered base system comprised of a wide-based frame and an interconnected rotatable base in operation on a surface where support of an arm and designated mechanically-hoisted load are augmented by a counterbalance system extending horizontally from the back side of a base and by a guy-wire system on the top of an arm and wide-based frame.

FIG. 7A is a side elevation view showing a portable crane and cantilevered base system 50 comprised of a wide-based frame 200 and an interconnected rotatable base system 300 in operation 800 on a surface 801. Support for an arm 100 and mechanically hoisted 503 designated load 500 on system 50 is augmented by a counterbalance system 600 extending horizontally from the back side of an upper base 301. A wire rope 501 or equivalent is used as a guy-wire on the top of a wide-based frame 200 and arm 100 held by hardware 104 on the top of an arm 100 and hardware 208 on the upper member 205 of a wide-based frame 200. In this example, operation 800 the designated load 500 is lifted by a mechanical hoist 503 or equivalent whereas the support of the load for system 50 is augmented by a counterbalance system 600 and a guy-wire support system comprised of a segment of wire rope 501 secured between hardware 104 and 208 on an arm and wide-based frame, respectively.

Figure 7B:
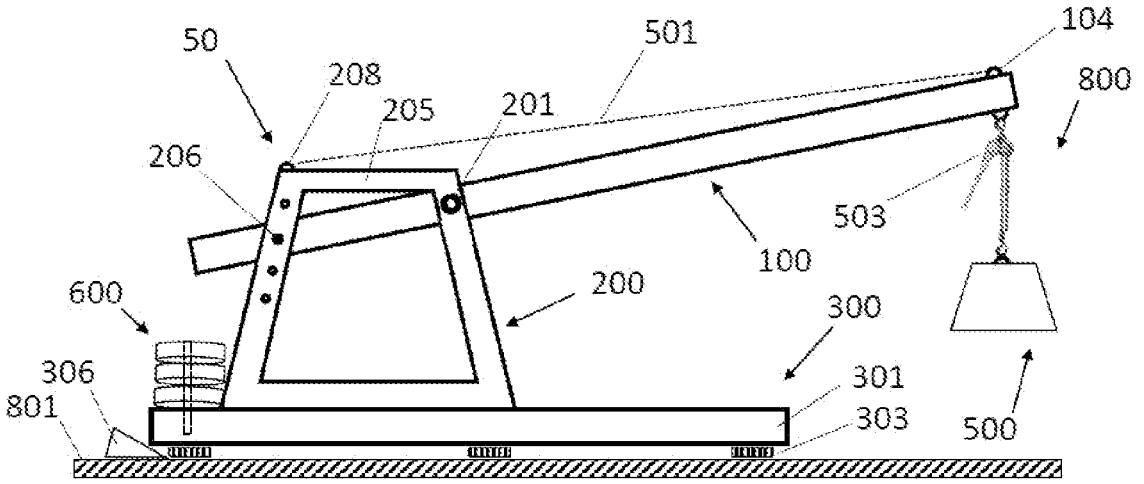
FIG. 7B is a side elevation view showing a portable crane and cantilevered base system comprised of a wide-based frame and a single interconnected rotatable base in operation on a surface where support of an arm and designated mechanically-hoisted load are augmented by a counterbalance system extending vertically from the back side of a base and a guy-wire system on the top of an arm and wide-based frame.

FIG. 7B is a side elevation view showing a portable crane and cantilevered base system 50 comprised of a wide-based frame 200 and a single interconnected rotatable base system 300 in operation 800 on a surface 801. Support for an arm 100 and mechanically hoisted 503 designated load 500 on system 50 is augmented by a counterbalance system 600 extending vertically from the back side of an upper base 301. A wire rope 501 or equivalent is used as a guy-wire on the top of a wide-based frame 200 and arm 100 held by hardware 104 on the top of an arm 100 and hardware 208 on the upper member 205 of a wide-based frame 200. In this example operation the designated load 500 is lifted by a mechanical hoist 503 or equivalent whereas the support of the load for system 50 is augmented by the counterbalance system 600 and the guy-wire support system comprised of a segment of wire rope 501 secured between hardware 104 and 208 on an arm and wide-based frame, respectively. A wedge device 306 or equivalent is shown to prevent movement of a system 50 on a surface 801.

Figure 8A:
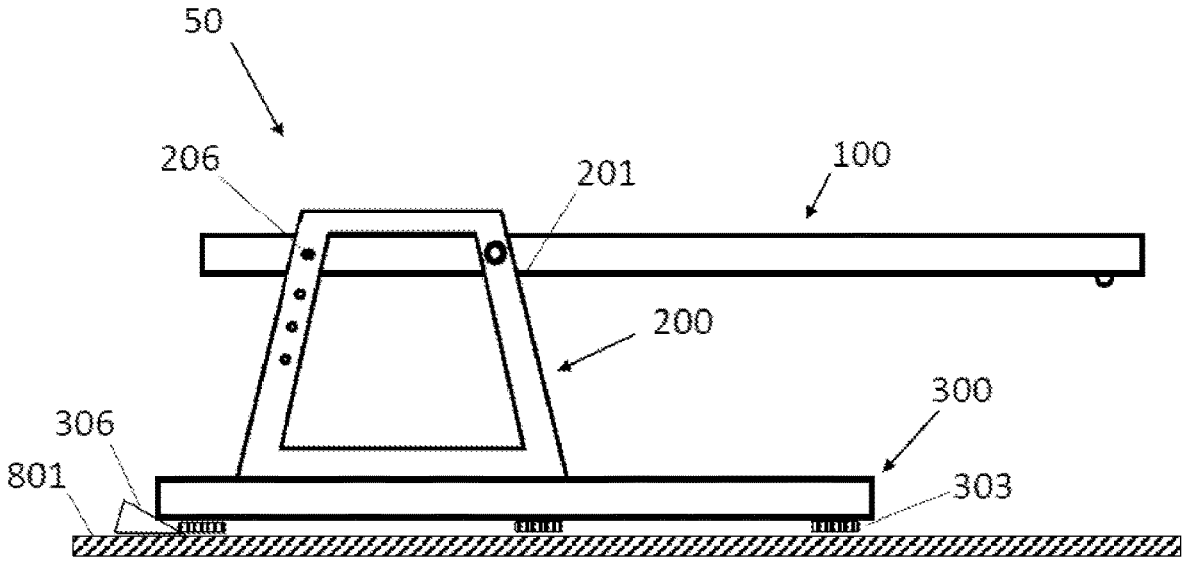
FIG. 8A is a side elevation view showing a portable crane and cantilevered base system comprised of a wide-based frame and a single interconnected rotatable base on a surface where an arm is in a horizontal position for transport or storage.

FIG. 8A is a side elevation view showing a portable crane and cantilevered base system 50 comprised of a wide-based frame 200 and a single interconnected rotatable base system 300 on a surface 801 where an arm 100 is in a horizontal position for transport or storage. In this example the lockpin 206 is in an upper hole (207 not shown). A wedge device 306 or equivalent device is shown to prevent movement of a system 50 on a surface 801.

Figure 8B:
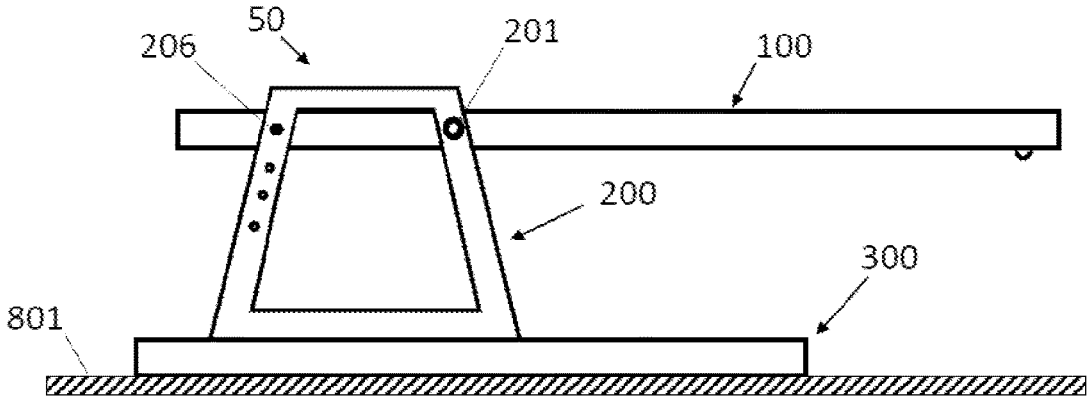
FIG. 8B is a side elevation view showing a portable crane and cantilevered base system comprised of a wide-based frame and a single interconnected non-rotatable base on a surface where an arm is in a horizontal position for transport or storage.

FIG. 8B is a side elevation view showing a portable crane and cantilevered base system 50 comprised of a wide-based frame 200 and a single interconnected non-rotatable base system 300 on a surface 801 where an arm 100 is in a horizontal position for transport or storage.

Figure 9:
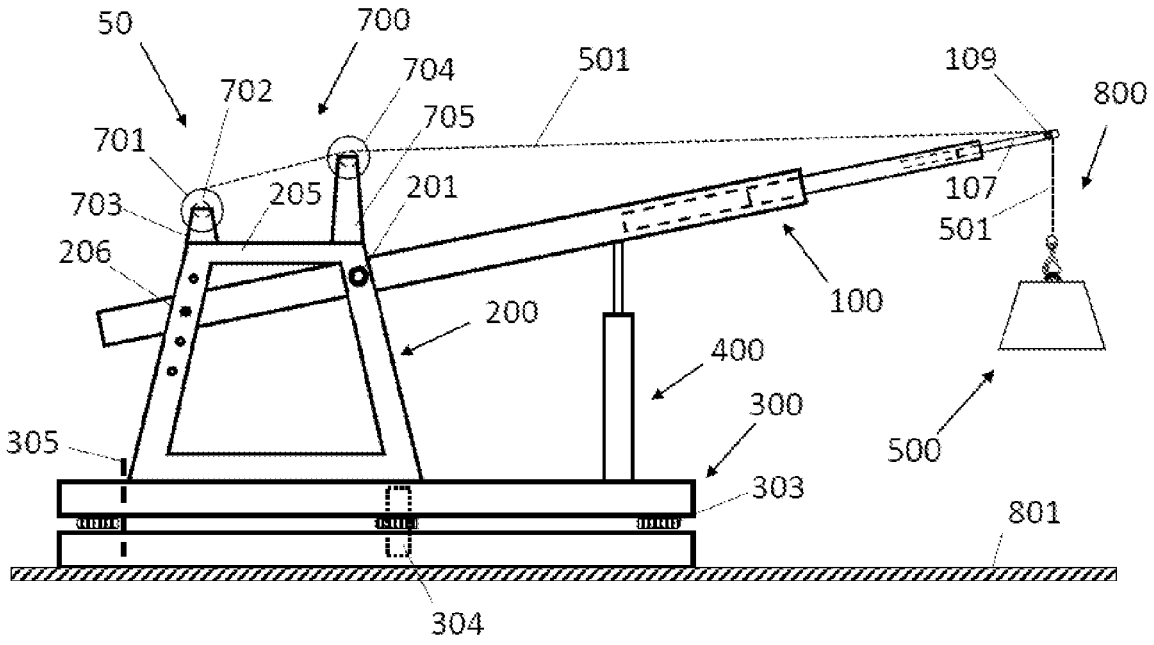
FIG. 9 is a side elevation view showing a portable crane and cantilevered base system comprised of a wide-based frame and an interconnected rotatable base in operation on a surface where the support of an arm and designated load are augmented by a mechanical lifting device and a separate mechanical winding device raises and lowers a designated load.

FIG. 9 is a side elevation view showing a portable crane and cantilevered base system 50 comprised of a wide-based frame 200 and an interconnected rotatable base system 300 supporting operation 800 on a surface 801. Support of an arm 100 and designated load 500 by a system 50 is augmented by a mechanical lifting device 400. A separate mechanical winding device 700 (e.g., a hand-cranked or motorized winch) is mounted on the top of a wide-based frame 200 to raise and lower the designated load 500.

In the example shown in FIG. 9 an arm 100 is telescopic and the smallest arm segment 107 contains a pulley wheel 109 (with a groove between the flanges around its circumference, not shown). The pulley wheel 109 rotates on an axle or shaft (not shown) inside an arm 107 to support and feed the wire rope 501 or equivalent as it is wound to or released from the mechanical winding device 700. In this example, the wire rope 501 is held within a reel 701 with walls to retain wound wire rope 501, which is wound around a cylindrical core 702 of the reel on an axle or shaft (not shown). The winding device shown in FIG. 9 is attached to the upper member 205 of a wide-based frame 200 by a mount 703. A separate pulley wheel 704 is supported by a taller mount 705 attached to the upper member 205 of a wide-based frame 200, wherein, in operation 800 the separate pulley wheel 704 maintains sufficient elevation and tension of the wire rope 501 above an arm 100 and supports the load 500.

Figure 10:
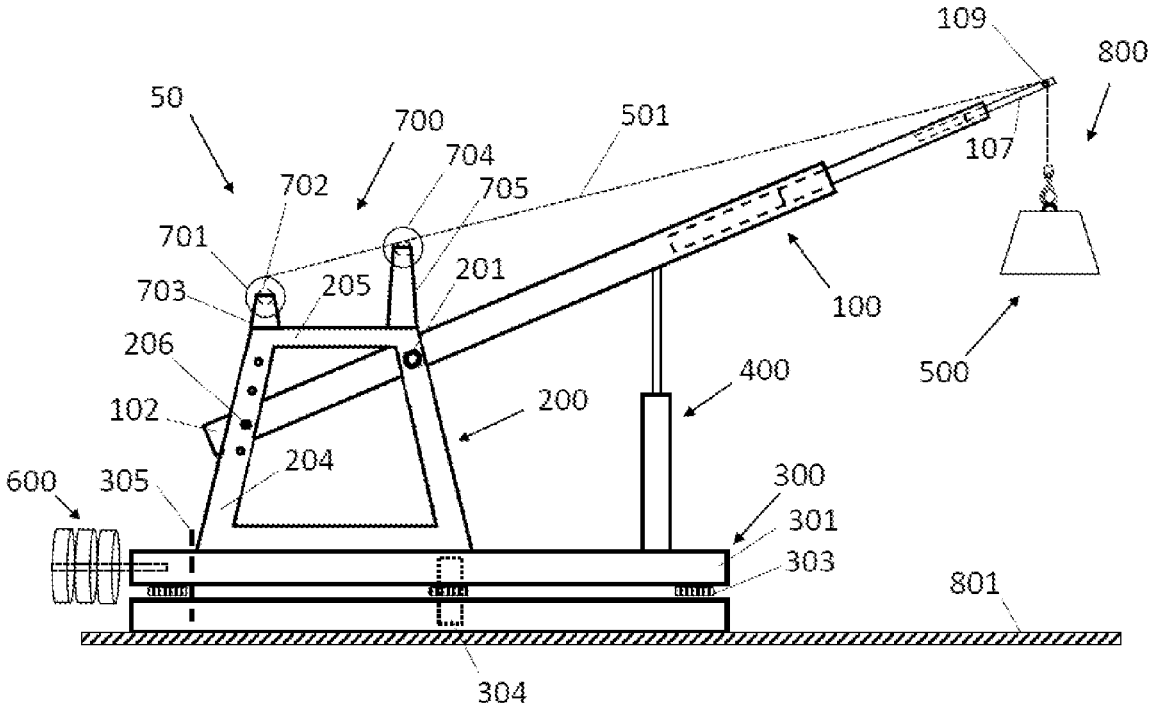
FIG. 10 is a side elevation view showing a portable crane and cantilevered base system comprised of a wide-based frame and an interconnected rotatable base in operation on a surface where the support of the inclined arm and the designated load are augmented by a mechanical lifting device and a separate mechanical winding device raises and lowers a designated load.

FIG. 10 is a side elevation view showing a portable crane and cantilevered base system 50 comprised of a wide-based frame 200 and an interconnected rotatable base system 300 supporting operation 800 on a surface 801. Support of an arm 100 and designated load 500 by a system 50 is augmented by a mechanical lifting device 400 in combination with a counterbalance system 600 extending horizontally from the back side of an upper base 301. A separate mechanical winding device 700 (e.g., a hand-cranked or motorized winch) is mounted on the top of a wide-based frame 200 to raise and lower the designated load 500. An arm in FIG. 10 is inclined more than in FIG. 9 and the detachably secured lockpin 206 is positioned in a lower elevation hole (207 not shown) in the back leg 204 of the wide-based frame 200 and extended through the short portion of an arm 102 to secure the entire arm 100 from rotation.

In the example shown in FIG. 10 an arm 100 is telescopic and the smallest arm segment 107 contains a pulley wheel 109 (with a groove between the flanges around its circumference, not shown). The pulley wheel 109 rotates on an axle or shaft (not shown) inside an arm 107 to support and feed the wire rope 501 or equivalent as it is wound to or released from the mechanical winding device 700. In this example, the wire rope 501 is held within a reel 701 with walls to retain wound wire rope 501, which is wound around a cylindrical core 702 of the reel on an axle or shaft (not shown). The winding device shown in FIG. 10 is attached to the upper member 205 of a wide-based frame 200 by a mount 703. A separate pulley wheel 704 is supported by a taller mount 705 attached to the upper member 205 of a wide-based frame 200, wherein, in operation 800 maintains sufficient elevation and tension of the wire rope 501 above an arm 100 and supports the load 500.

Figure 11:
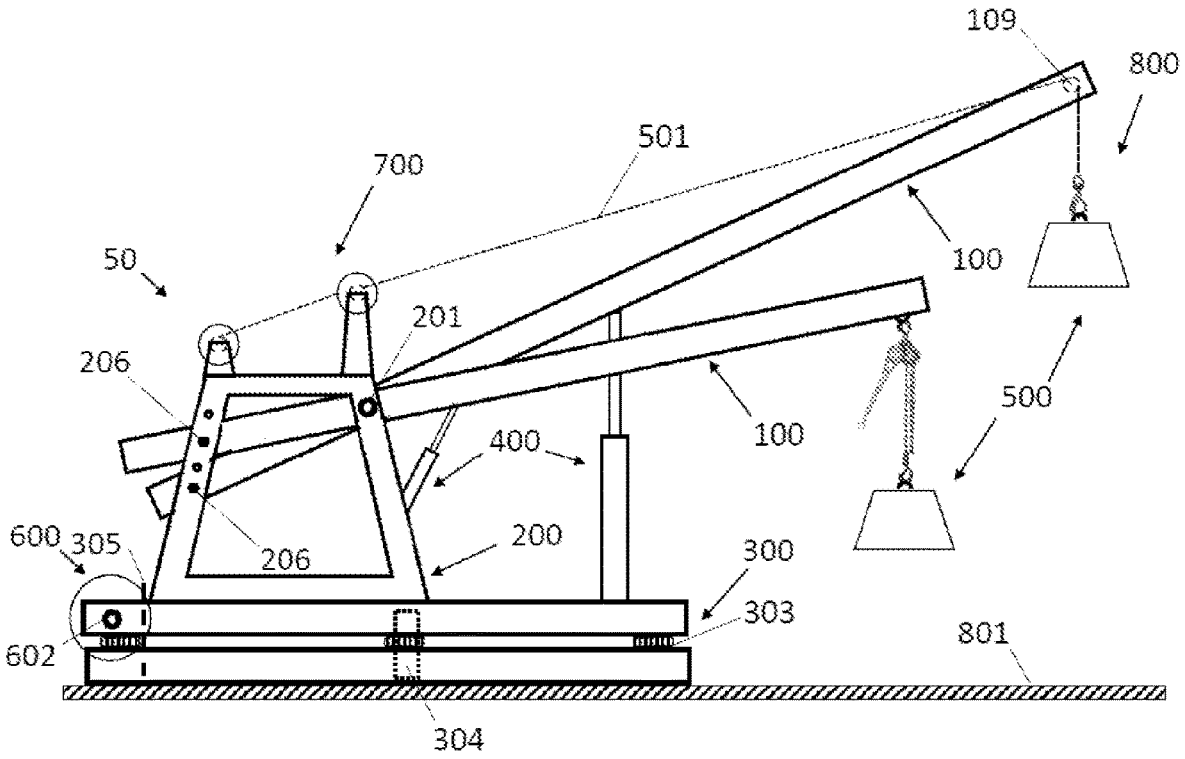
FIG. 11 is a side elevation view showing a portable crane and cantilevered base system comprised of a wide-based frame and an interconnected rotatable base in operation on a surface where with two inclined and pivotable arms each having designated loads. Support of the portable crane and cantilevered base system shown in FIG. 11 is augmented by mechanical lifting devices detachably secured to a base or a leg of a wide-based frame. A mechanical winding device on one arm is detachably secured to the top of a wide-based frame, a mechanically hoisted and designated load is held by another arm, and a counterbalance system is on the back of a base system.

FIG. 11 is a side elevation view showing a portable crane and cantilevered base system 50 with two pivotable arms 100 on a wide-based frame 200 and an interconnected rotatable base 300 in operation 800 on a surface 801 where both arms 100 and designated loads 500 are inclined and support of a system 50 is augmented by mechanical lifting devices 400 detachably secured to a base system 300 or a leg of a wide-based frame 200. A mechanical winding device 700 on one arm is detachably secured to the top of a wide-based frame 200, a mechanically hoisted and designated load 500 is held by another arm, and a counterbalance system 600 is on the back of a base system 300.

Figure 12:
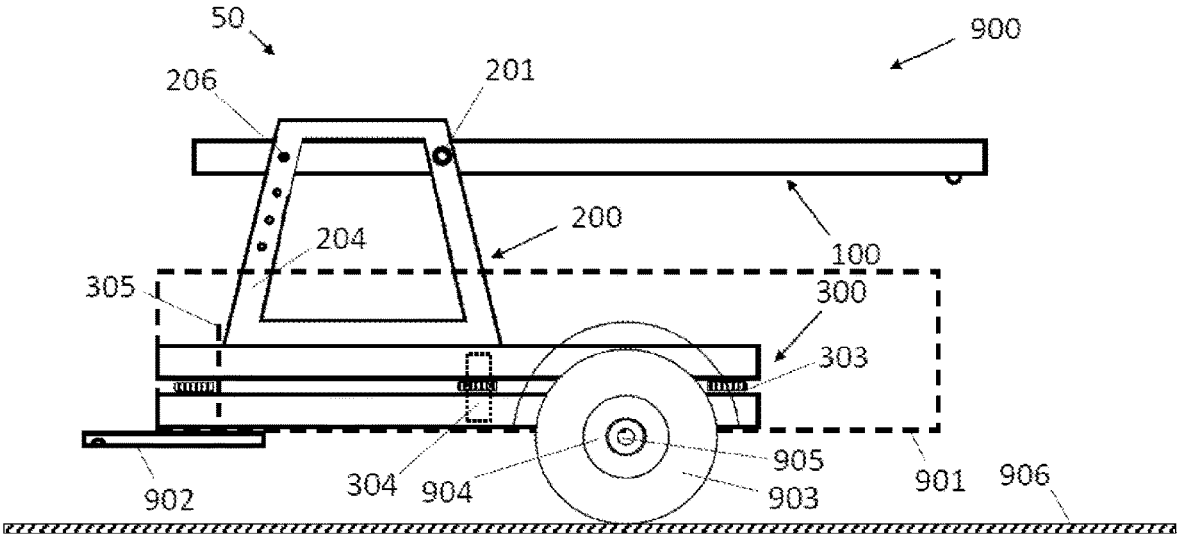
FIG. 12 is a side elevation view showing a portable crane and cantilevered base system comprised of a wide-based frame and interconnected rotatable base in a non-motorized vehicle where an arm is in a horizontal position for transport.

FIG. 12 is a side elevation view showing a portable crane and cantilevered base system 50 comprised of a wide-based frame 200 and interconnected rotatable base system 300 in a non-motorized vehicle 900 (e.g., the floor of a trailer) where an arm 100 is in a horizontal position for transport. The non-motorized vehicle shown in the example in FIG. 12 represents a trailer 901 or similar with a tongue 902 for towing. The trailer 901 is supported by a tire 903, wheel 904, and axle 905 shown on a road or a ground surface 906. A lockpin 206 is in an upper hole 207 (not shown) in a back leg 204 of a wide-based frame 200 to keep an arm from moving during transport and a lockpin 305 is in the base system 300 to prevent a wide-based frame 200 and arm 100 from rotating during transport.

Figure 13:
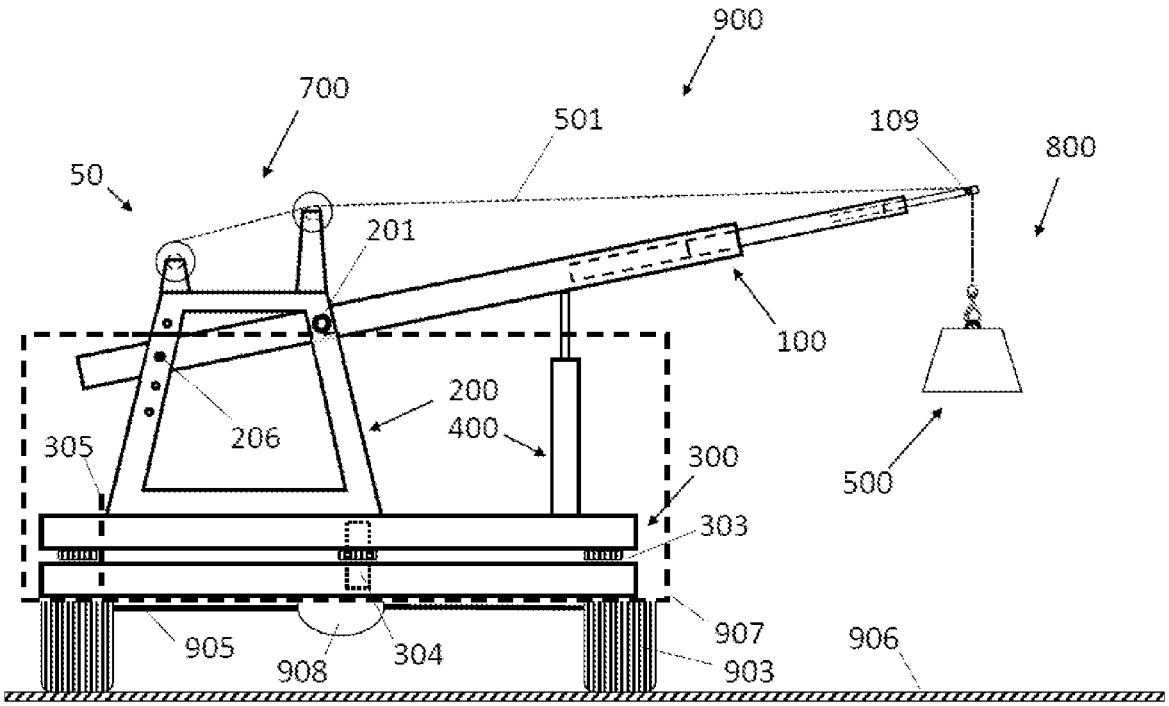
FIG. 13 is a side elevation view from the back side of a motorized vehicle showing a portable crane and cantilevered base system comprised of a wide-based frame and interconnected rotatable base system in operation. Support of the telescopic arm and designated load of the portable crane and cantilevered base system shown in FIG. 13 is augmented by a mechanical lifting device and a separate mechanical winding device is mounted on the top of a wide-based frame to raise and lower a designated load.

FIG. 13 is a side elevation view from the back side of a motorized vehicle 900 showing a portable crane and cantilevered base system 50 comprised of a wide-based frame 200 and interconnected rotatable base system 300 in operation 800. Support of an arm 100 and designated load 500 by a system 50 is augmented by a mechanical lifting device 400. A separate mechanical winding device 700 (e.g., a hand-cranked or motorized winch) is mounted on the top of a wide-based frame 200 to raise and lower the designated load 500. An arm 100 in this example is telescopic. The motorized vehicle shown in this example represents the bed of a truck 907 or similar and is shown on a road or ground 906 and supported by a tire 903, axle 905, and differential 908.

Figure 14:
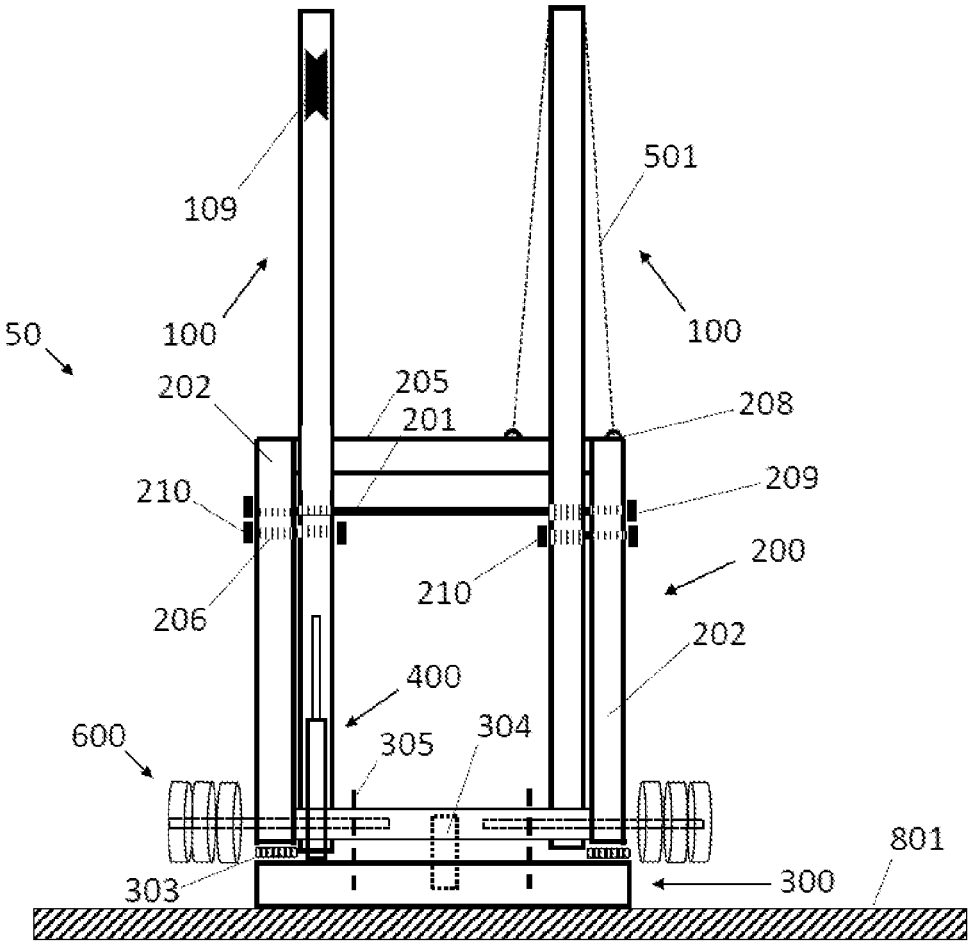
FIG. 14 is a side elevation view from the front showing a portable crane and cantilevered base system comprised of a wide-based frame and an interconnected rotatable base with a two pivotable arms on a surface. Support of the arms of the portable crane and cantilevered base system shown in FIG. 14 is augmented with a counterbalance system extending horizontally from the back side of a base, a mechanical lifting device augments support of a left arm, and a guy-wire system augments support of a right arm.

FIG. 14 is a side elevation view from the front of a portable crane and cantilevered base system 50 showing two pivotable arms 100, a wide-based frame 200, an interconnected rotatable base system 300 on a surface 801, with a counterbalance system 600 extending horizontally from the back sides of a base 300 for augmented support to a system 50. A mechanical lifting device 400 augments support of the left arm and a guy-wire support system augments support of the right arm, comprised of two segments of wire rope 501 secured between hardware 208 on the upper member 205 of a wide-based frame 200 (hardware 104 on the top of arm 100 not shown).

The left arm 100 shows a pulley wheel 109 with a groove between the flanges around its circumference to accommodate wire rope 501 (not shown) to lift a load 500 (not shown) by a mechanical winding device 700 (not shown) mounted (not shown) on the upper member 205 of a wide-based frame 200. The base system 300 includes two bases interconnected by a center pivot point 304 enabling 360-degree rotation of a system 50. Two detachably secured lockpins 305 connect the upper and lower bases to prevent base system 300 from rotation during operation or transport.

An extended pivot point 201 shown in FIG. 14 extends through both front legs 202 of a wide-based frame 200 and both arms 100. Hardware 209 (e.g., a threaded nut) secures both ends of the pivot point 201. The relative position of two detachably secured lockpins 206 are projected in the back legs 204 (not shown) of a wide-based frame 200 and both arms 100. Hardware 210 (e.g., a threaded nut) secures both ends of the lockpins.

Figures 15A, 15B:
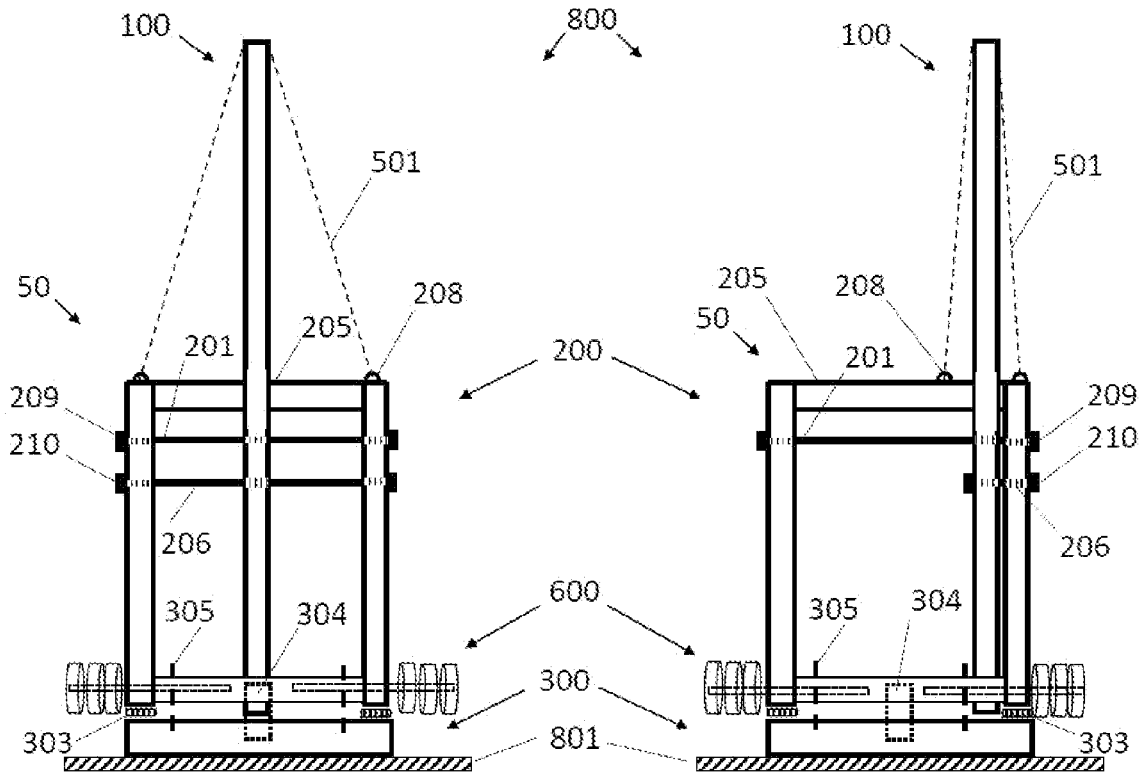
FIG. 15A is a side elevation view from the front showing a portable crane and cantilevered base system comprised of a wide-based frame with a centered pivotable arm and an interconnected rotatable base system on a surface with a counterbalance system extending horizontally from the back sides of a base for augmented support. A guy-wire support system holds a centered arm for augmented support.
FIG. 15B is a side elevation view from the front showing a portable crane and cantilevered base system comprised of a wide-based frame with and off-centered arm to the right and an interconnected rotatable base system on a surface with a counterbalance system extending horizontally from the back sides of a base for augmented support. A guy-wire support system holds an off-centered arm for augmented support.

FIG. 15A is a side elevation view from the front showing a portable crane and cantilevered base system 50 with a pivotable arm 100 centered in a wide-based frame 200 and an interconnected rotatable base system 300 on a surface 801 with a counterbalance system 600 extending horizontally from the back sides of a base 300 for augmented support of system 50. A guy-wire support system holds the centered arm 100 for augmented support of an arm 100 and is comprised of two segments of wire rope 501 secured between hardware 208 on the upper member 205 of a wide-based frame 200 (hardware 104 on the top of an arm 100 is not shown). The base system 300 includes a plurality of wheels 303 integrated between two interconnected bases held by a center pivot point 304 enabling 360-degree rotation of a wide-based frame and a system 50.

FIG. 15B is a side elevation view from the front showing a portable crane and cantilevered base system 50 with an pivotable arm 100 off-centered to the right of a wide-based frame 200 and an interconnected rotatable base system 300 on a surface 801 with a counterbalance system 600 extending horizontally from the back sides of a base 300. A guy-wire support system holds the off-centered arm 100 for augmented support of an arm 100 and is comprised of two segments of wire rope 501 secured between hardware 208 on the upper member 205 of a wide-based frame 200 (hardware 104 on the top of an arm 100 is not shown). The base system 300 includes a plurality of wheels 303 integrated between two interconnected bases held by a center pivot point 304 enabling 360-degree rotation of a system 50.

Figure 16:
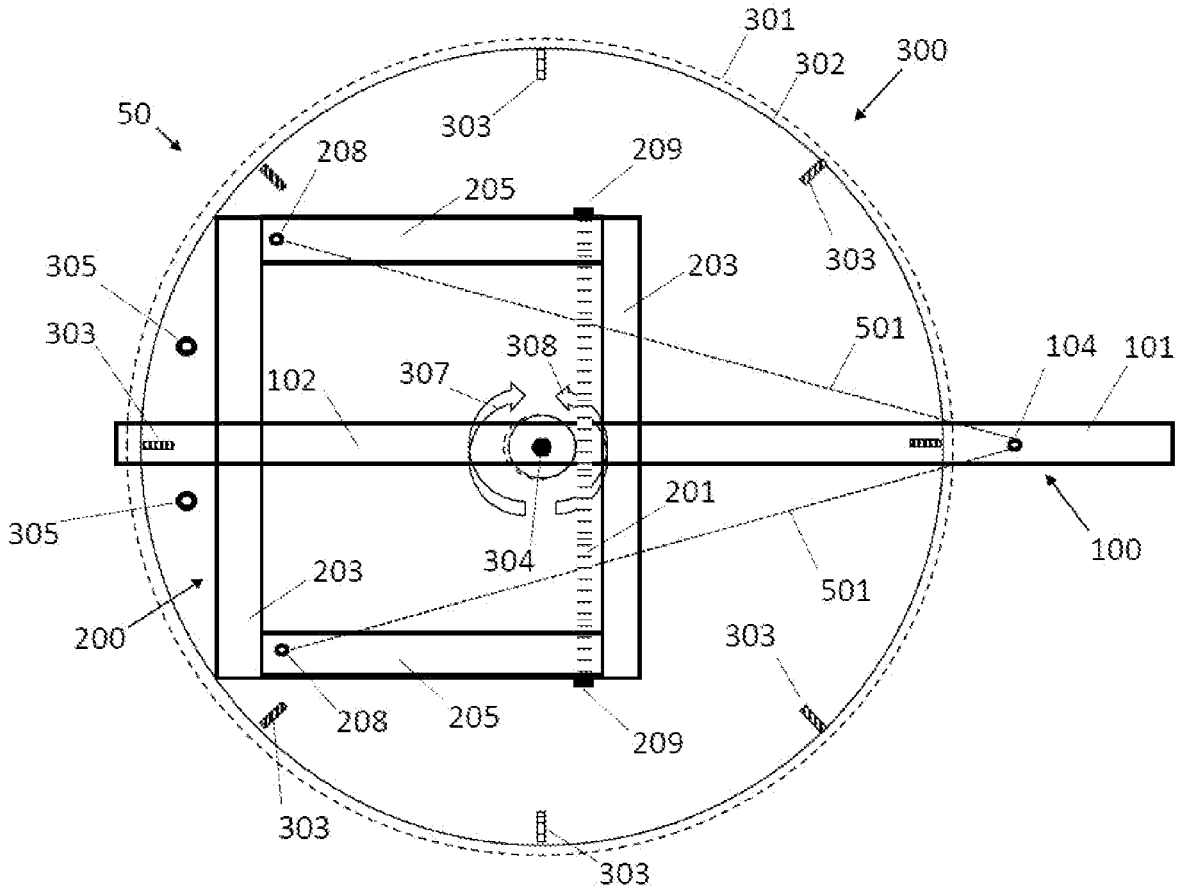
FIG. 16 is an overhead view showing a portable crane and cantilevered base system comprised of a wide-based frame offset to the back and an interconnected circular rotatable base with a guy-wire support system augmenting support of a centered arm that extends to the front of the crane.

FIG. 16 is an overhead view showing a portable crane and cantilevered base system 50 comprised of a wide-based frame 200 and an interconnected rotatable base system 300 consisting of an upper base 301 (shown as a circular base with dashed lines in order to see the top surface of the underlying lower base 302 which is also circular). A plurality of detachably secured wheels 303 (e.g., casters or rollers) are shown on the top surface of the lower base 302. The two bases are interconnected by a center pivot point 304 enabling 360-degree horizontal rotation of a wide-based frame 200 of system 50. A wide-based frame 200 and upper base 301 can rotate clockwise 307 or counterclockwise 308. Two detachably secured lockpins 305 are shown to secure the upper base 301 and lower base 302 behind a wide-based frame 200 to prevent the base system 300 from rotation during operation or transport.

The guy-wire support system shown in FIG. 16 for an arm 100 is comprised of two segments of wire rope 501 secured between hardware 104 and 208 on the top of an arm and on the upper member 205 of a wide-based frame 200, respectively. The long portion 101 of an arm 100, pivots vertically on a wide-based frame 200 at a pivot point 201 on the front leg 202 (not shown) of a wide-based frame 200 where a short portion 102 of an arm 100 extends on the backside of the pivot point 201. Hardware 209 secures both ends of the pivot point 201.

Particular embodiments and features have been described with reference to the drawings. It is to be understood that these descriptions are not limited to any single embodiment or any particular set of features, and that similar embodiments and features may arise, or modifications and additions may be made without departing from the scope of these descriptions and the spirit of the appended claims.

What is claimed is:

1. A portable crane and cantilevered base system comprising:

a wide-based frame that is wider at a bottom of the frame than at a top of the frame;

a circular upper base beneath the wide-based frame on which the wide-based frame is detachably secured to and off-centered on a back side of the upper base;

a plurality of wheels integrated beneath the upper base, wherein, the wheels are configured to enable horizontal rotation of the wide-based frame detachably secured to and off-centered on the back side of the upper base;

a removable wedge device beneath an edge of the upper base configured to disable horizontal rotation of the wide-based frame detachably secured to and off-centered on the back side of the upper base;

a circular lower base parallel to the upper base;

a vertically oriented center pivot point detachably securing the upper base and the lower base configured to enable horizontal rotation of the wide-based frame detachably secured to and off-centered on the back side of the upper base;

a vertically oriented lockpin detachably secured between the upper base and the lower base configured to disable horizontal rotation of the wide-based frame detachably secured to and off-centered on the back side of the upper base;

a pivotal arm, a long portion of which is detachably secured to a pivot point near the top of a front leg on a front side of the wide-based frame, the long portion of the pivotal arm extending beyond the upper base and the lower base on the front side of the wide-based frame;

the pivotal arm, a short portion of which is detachably secured to an opposing back leg on a back side of the wide-based frame at a same or lower elevation on the back leg as the pivot point on the front leg on the front side of the wide-based frame, the short portion of the pivotal arm not extending beyond the upper base and the lower base;

a second lockpin horizontally positioned in one of a plurality of holes on the back leg of the wide-based frame detachably secured to the short portion of the pivotal arm;

a steel loop attached on a bottom near an end of the long portion of the pivotal arm, a mechanical lifting device configured to vertically lift or lower a load, an end of the mechanical lifting device detachably secured to and suspended from the steel loop on the bottom near the end of the long portion of the pivotal arm, and an opposing end of the mechanical lifting device detachably secured to a hook, the hook detachably secured to a load beneath the long portion of the pivotal arm extending beyond the upper base and the lower base;

a second mechanical lifting device, a bottom of which is detachably secured to the upper base and a top of which is detachably secured to a bottom of the long portion of the pivotal arm at a location between the pivot point near the top of the front leg on the front side of the wide-based frame and the end of the long portion of the pivotal arm, wherein, the second mechanical lifting device is configured to structurally support and vertically lift or lower the long portion of the pivotal arm;

a counterbalance system detachably secured to the upper base near the back side of the wide-based frame.

2. The portable crane and cantilevered base system of claim 1, further comprising:

a horizontal upper member of the wide-based frame parallel to a lower member of the wide-based frame, wherein, the lower member is longer than the upper member;

a top of the front leg on the front of the wide-based frame attached to an end of the upper member;

a bottom of the front leg on the front of the wide-based frame attached to an end of the lower member;

a back leg on the back side of the wide-based frame that is not parallel to the front leg on the front side of the wide-based frame;

a top of the back leg on the back side of the wide-based frame attached to an opposing end of the upper member relative to the front leg on the front side of the wide-based frame;

a bottom of the back leg on the back side of the wide-based frame attached to an opposing end of the lower member relative to the front leg on the front side of the wide-based frame;

wherein, the front leg, the back leg, the upper member, and the lower member comprise a first side of the wide-based frame;

a second horizontal upper member of the wide-based frame parallel to a second lower member of the wide-based frame, wherein the second lower member is longer than the upper member;

a top of a second front leg on the front of the wide-based frame attached to an end of the second upper member;

a bottom of the second front leg on the front of the wide-based frame attached to an end of the second lower member;

a second back leg on the back side of the wide-based frame that is not parallel to the second front leg;

a top of the second back leg on the back side of the wide-based frame attached to an opposing end of the second upper member relative to the second front leg on the front side of the wide-based frame;

a bottom of the second back leg on the back side of the wide-based frame attached to an opposing end of the second lower member relative to the second front leg on the front side of the wide-based frame;

wherein, the second front leg, the second back leg, the second upper member, and the second lower member comprise a second side of the wide-based frame;

wherein, the first side and the second side of the wide-based frame are parallel to each other, horizontally separated from each other, and horizontally attached to each other.

3. The portable crane and cantilevered base system of claim 1, further comprising:

a cavity near the end of the long portion of the pivotal arm;

a mechanically extractable, first telescopic arm that fits inside the cavity near the end of the long portion of the pivotal arm;

a steel loop attached on a top near an end of the first telescopic arm;

a second cavity near the end of the first telescopic arm;

a second mechanically extractable telescopic arm that fits inside the second cavity near the end of the first telescopic arm; and a second steel loop attached on a bottom near an end of the second telescopic arm.

4. The portable crane and cantilevered base system of claim 1, further comprising:

a steel loop attached to a top of an upper member on a first side of the wide-based frame;

a second steel loop attached to a top of an opposing upper member on a second side of the wide-based frame;

a guy-wire detachably secured between the first steel loop on the top of the upper member of the first side of the wide-based frame and the steel loop on the top near the end of the long portion of the pivotal arm; and a second guy-wire detachably secured between the second steel loop on the top of the upper member of the second side of the wide-based frame and the steel loop on the top near the end of the long portion of the pivotal arm.

5. The portable crane and cantilevered base system of claim 1, further comprising:

a mechanical winding device detachably secured to an upper member of the wide-based frame;

a reel detachably secured inside the mechanical winding device;

a wire rope, one end detachably secured to the reel inside of the mechanical winding device, the other end of the wire rope detachably secured to a steel loop attached on the top near the end of a first telescopic arm within the long portion of the pivotal arm extending beyond the upper base and the lower base;

wherein, the mechanical winding is configured to raise or lower the long portion of the pivotal arm.

6. The portable crane and cantilevered base system of claim 1, further comprising:

a tall mount attached to an upper member on the front side of the wide-based frame;

a pulley wheel detachably secured inside the tall mount;

a pulley wheel detachably secured inside an end of a telescopic arm;

a mechanical winding device detachably secured to the upper member on the back side of the wide-based frame;

wire rope, one end detachably secured to a hook, wherein the hook is detachably secured to a load beneath the second pulley inside the end of the telescopic arm, wherein, the other end of the second wire rope is detachably secured on a reel inside of the second mechanical winding device;

wherein, the wire rope is supported by the pulley wheel inside the tall mount at an elevation above the winding device on the upper member on the back side of the wide-based frame;

wherein, the second mechanical winding device is configured to vertically lift or lower a load detachably secured to the hook at the end of the wire rope.

7. The portable crane and cantilevered base system of claim 1, further consisting of:

a second pivotal arm, a long portion of which is detachably secured to a second pivot point near a top of a second front leg on the front on a second side of the wide-based frame;

a short portion of the second pivotal arm detachably secured to an opposing second back leg on the second side of wide-based frame at a same or lower elevation on the second back leg as the second pivot point on the second front leg of the wide-based frame;

a second lockpin horizontally positioned in one of a plurality of holes on the second back leg on the second side of the wide-based frame detachably secured to the short portion of the second pivotal arm;

a third mechanical lifting device, a bottom of which is detachably secured to the second front leg on the second side of the wide-based frame and a top of which is detachably secured to a bottom of the long portion of the second pivotal arm near the second pivot point on the second front leg on the second side of the wide-based frame;

wherein, the long portion of the second pivotal arm on the second side of the wide-based frame is a different length and a different structural capacity relative to the long portion of the first pivotal arm on a first side of the wide-based frame;

wherein, the second pivotal arm on the second side of the wide-based frame is configured to operate separately from the first pivotal arm on the first side of the wide-based frame;

wherein, the third mechanical lifting device is configured to structurally support and vertically lift or lower the long portion of the second pivotal arm.

8. The portable crane and cantilevered base system of claim 1, further consisting of:

a non-motorized vehicle adapted to secure and transport the portable crane and cantilevered base system by a motorized towing vehicle;

wherein, the non-motorized vehicle is configured to enable operation of the portable crane and cantilevered base system without removal from the non-motorized vehicle.

9. The portable crane and cantilevered base system of claim 1, further consisting of:

a bed of a motorized vehicle, wherein the bed of the motorized vehicle is adapted to secure and transport the portable and cantilevered base system;

wherein, the bed of the motorized vehicle is configured to enable operation of the portable crane and cantilevered base system without removal from the bed of the motorized vehicle.

* * * * *